US007221250B2

(12) United States Patent
Yoshida et al.

(10) Patent No.: US 7,221,250 B2
(45) Date of Patent: May 22, 2007

(54) COIL COMPONENT AND METHOD OF MANUFACTURING THE SAME

(75) Inventors: Makoto Yoshida, Tokyo (JP); Nobuyuki Okuzawa, Tokyo (JP); Tomokazu Ito, Tokyo (JP); Yukari Hishimura, Tokyo (JP); Yoshikazu Sato, Tokyo (JP)

(73) Assignee: TDK Corporation, Tokyo (JP)

( * ) Notice: Subject to any disclaimer, the term of this patent is extended or adjusted under 35 U.S.C. 154(b) by 59 days.

(21) Appl. No.: 11/063,829

(22) Filed: Feb. 23, 2005

(65) Prior Publication Data

US 2005/0195062 A1 Sep. 8, 2005

(30) Foreign Application Priority Data

Feb. 25, 2004 (JP) ..... 2004-049902

(51) Int. Cl.
*H01F 5/00* (2006.01)

(52) U.S. Cl. ..... 336/200; 336/223; 336/232

(58) Field of Classification Search ..... 336/200, 336/223, 232; 29/602.1
See application file for complete search history.

(56) References Cited

U.S. PATENT DOCUMENTS 5,402,293 A * 3/1995 Smith ..... 369/13.1
6,198,374 B1 * 3/2001 Abel ..... 336/200
6,246,541 B1 * 6/2001 Furuichi et al. ..... 360/123
6,624,498 B2 * 9/2003 Filas et al. ..... 257/528
6,710,694 B2 3/2004 Matsuta et al.

FOREIGN PATENT DOCUMENTS

| | | |
|---|---|---|
| JP | 02-025003 | 1/1990 |
| JP | 11-054326 | 2/1999 |
| JP | 2003-133135 | 5/2003 |

* cited by examiner

*Primary Examiner*—Anh Mai
(74) *Attorney, Agent, or Firm*—Oliff & Berridge, PLC

(57) ABSTRACT

The invention relates to a coil component used as a major component of a common mode choke coil or transformer and a method of manufacturing the same, and the invention is aimed at providing a compact and low-profile coil component having a high common mode filtering property and a method of manufacturing the same. A common mode choke coil has a configuration in which a first insulation film, a first coil conductor, a second insulation film, a second coil conductor and a third insulation film are stacked in the order listed between magnetic substrates provided opposite to each other. A top portion of the first coil conductor is formed in a convex shape. The second insulation film is formed so as to follow the shape of the top portion of the first coil conductor. A bottom portion of the second coil conductor is formed in a concave shape such that it follows the shape of a top portion of the second insulation film.

7 Claims, 6 Drawing Sheets

15
21b
21b
21b

COIL COMPONENT AND METHOD OF MANUFACTURING THE SAME

BACKGROUND OF THE INVENTION

1. Field of the Invention

The present invention relates to a coil component used as a major component of a common mode choke coil or a transformer and a method of manufacturing the same.

2. Description of the Related Art

Reductions in the size of electronic apparatus such as personal computers and portable phones have resulted in demand for reductions in the size and thickness (height) of electronic components such as coils and capacitors mounted on internal circuits of electronic apparatus.

However, a wire-wound coil obtained by winding a copper wire around a ferrite core has a problem in that it is difficult to make compact because of structural limitations. Under the circumstance, research and development is active on chip-type coil components which can be provided with a small size and a small height. Known chip-type coil components include multi-layer type coil components provided by forming coil conductor patterns on surfaces of magnetic sheet made of ferrite and stacking the magnetic sheets and thin film type coil components provided by forming insulation films and coil conductors constituted by metal thin films alternately using thin film forming techniques.

Common mode choke coils are known as thin film type coil components. FIGS. 7A and 7B are sectional views of common mode choke coils 51 taken along a plane including center axes of coil conductors 59 and 61. FIG. 7A shows a common mode choke coil 51 having coil conductors 59 and 61 which are curved in the form of a convex in a top portion thereof when viewed in the coil section. FIG. 7B shows a common mode choke coil 51 having coil conductors 59 and 61 having a rectangular coil section. As shown in FIGS. 7A and 7B, the common mode choke coils 51 have an insulation layer 57 formed by stacking an insulation film between ferrite substrates (magnetic substrates) 53 and 55 which are provided opposite to each other. The coil conductors 59 and 61, which are provided opposite to each other with the insulation film interposed between them and formed in a spiral configuration, are embedded in the insulation layer 57. The insulation layer 57 and the coil conductors 59 and 61 are formed in the order listed using thin film forming techniques.

An opening 63 is formed on an inner circumferential side of the spiral coil conductors 59 and 61 by removing the insulation layer 57. An opening 65 is formed on an outer circumferential side of the spiral coil conductors 59 and 61 by removing the insulation layer 57. Magnetic layers 67 are formed to fill the openings 63 and 65. Further, a bonding layer 69 is formed on the magnetic layers 67 and the insulation layer 57 to bond a magnetic substrate 55.

When the coil conductors 59 and 61 are energized, a magnetic path M is formed such that it passes through the magnetic substrate 53, the magnetic layer 67 in the opening 63, the bonding layer 69, the magnetic substrate 55, the bonding layer 69 again, and the magnetic layer 67 in the opening 65 in the section including the center axes of the coil conductors 59 and 61. The bonding layer 69 is a film having a thickness on the order of a few μm, although it is non-magnetic. Therefore, substantially no leakage of the magnetic flux occurs in this part, and the magnetic path M may be regarded as a substantially closed path.

In order to improve the common mode filtering property of the common mode choke coil 51, strong magnetic coupling must be achieved between the coil conductors 59 and 61. To increase the strength of the magnetic coupling between the coil conductors 59 and 61, it is necessary to increase the numbers of turns of the coil conductors 59 and 61, to reduce the magnetic path length of the magnetic path M, and to space the layers of the coil conductors 59 and 61 at a small and uniform distance. The numbers of turns of the coil conductors 59 and 61 may be increased in a limited region by reducing the conductor width of the coil conductors 59 and 61 and intervals between adjoining parts of the conductors to reduce the pitches of the conductors. However, a reduction in the conductor width results in an increase in the resistance of the coil conductors 59 and 61. Under the circumstance, the ratio between the height and width (aspect ratio) of the coil sections of the coil conductors 59 and 61 may be increased to maintain the areas of the coil sections substantially constant, so that the resistance will not increase.

Patent Document 1: JP-A-2003-133135

Patent Document 2: JP-A-11-54326

Patent Document 3: Japanese Patent Application No. 2003-307372

Patent Document 4: Japanese Patent No. 2011372

However, as shown in FIG. 7A, when coil conductors 59 and 61 having an aspect ratio of 0.5 or more are formed using an electro-plating process, the top surfaces of the coil conductors 59 and 61 are curved in the form of convexes, and the bottom surfaces have a planar shape. Therefore, the inter-layer distance between the coil conductors 59 and 61 is shortest at the convex parts of the top surfaces of the coil conductors 59 and gradually increases toward both sides of the convexes. As a result, a capacitance (stray capacitance) between the coil conductors 59 and 61 decreases to reduce the degree of magnetic coupling between the coil conductors 59 and 61, which results in a problem in that the common mode filter property is degraded.

A method for suppressing the reduction in the degree of magnetic coupling attributable to the shape of the top surfaces of the coils is to planarize the top surfaces of the coil conductors 59 and 61 using a chemical mechanical polishing process (CMP process) to make the coil sections rectangular, as shown in FIG. 7B. In this case, however, the manufacturing cost is increased because of the need for the step for planarizing the top surfaces of the coil conductors 59 and 61.

As thus described, when it is attempted to improve the degree of magnetic coupling by increasing the numbers of turns of the coil conductors 59 and 61 or decreasing the magnetic path length for the purpose of improving common mode filtering property, the capacitance generated between the coil conductors 59 and 61 decreases to hinder a sufficient improvement of the degree of magnetic coupling. When the top surfaces of the coil conductors 59 and 61 are planarized to increase the capacitance of coupling between the coil conductors 59 and 61, the number of manufacturing steps increases, and this can result in the problem of an increase in the cost of the common mode choke coil 51 through an increase in the manufacturing cost.

SUMMARY OF THE INVENTION

It is an object of the invention to provide a compact and low-profile coil component having a high common mode filtering property and a method of manufacturing the same.

The above-described object is achieved by a coil component characterized in that it has a first coil conductor formed with a curved top portion, an insulation film formed on the first coil conductor so as to follow the shape of the top portion of the first coil conductor, a second coil conductor formed on the insulation film, the second coil conductor having a bottom portion formed so as to follow the shape of a top portion of the insulation film.

The above invention provides a coil component, characterized in that the center of the top portion of the first coil conductor has a convex shape in a section of the coil.

The above invention provides a coil component, characterized in that the second coil conductor is formed directly above the first coil conductor with the insulation film interposed between them.

The above invention provides a coil component, characterized in that at least either of the first or the second coil conductors is formed such that a section of the coil has an aspect ratio of 0.5 or more.

The above invention provides a coil component, characterized in that the distance between the first and second coil conductors is substantially constant.

The above invention provides a coil component, characterized in that the insulation film is formed of a shrinkable resist material.

The above-described object is achieved by a method of manufacturing a coil component, characterized in that it includes the steps of forming a first coil conductor having a curved top portion on a magnetic substrate, forming an insulation film on the first coil conductor such that it follows the shape of the top portion of the first coil conductor, and forming a second coil conductor on the insulation film, the second coil conductor having a bottom portion that follows the shape of a top portion of the insulation film.

The above invention provides a method of manufacturing a coil component, characterized in that it includes a step of shrinking and hardening a resist film made of a shrinkable resist material by heating the resist film to form the insulation film.

The above invention provides a method of manufacturing a coil component, characterized in that the resist film is formed such that it is higher than the uppermost portion of the first coil conductor by 20 to 50% of the height of the first coil conductor.

The above invention provides a method of manufacturing a coil component, characterized in that the first and second coil conductors are formed using a frame plating process.

The above invention provides a method of manufacturing a coil component, characterized in that the second coil conductor is formed above a convex portion of the insulation film.

The invention provides a method of manufacturing a coil component, characterized in that at least either of the first or the second coil conductors is formed such that a section of the coil has an aspect ratio of 0.5 or more.

The invention makes it possible to provide a compact and low-profile coil component having a high common mode filtering property.

BRIEF DESCRIPTION OF THE DRAWINGS

FIGS. 3A to 3C are sectional views of the common mode choke coil 1 according to the embodiment of the invention taken at manufacturing steps;

DESCRIPTION OF THE PREFERRED EMBODIMENTS

Figure 1:
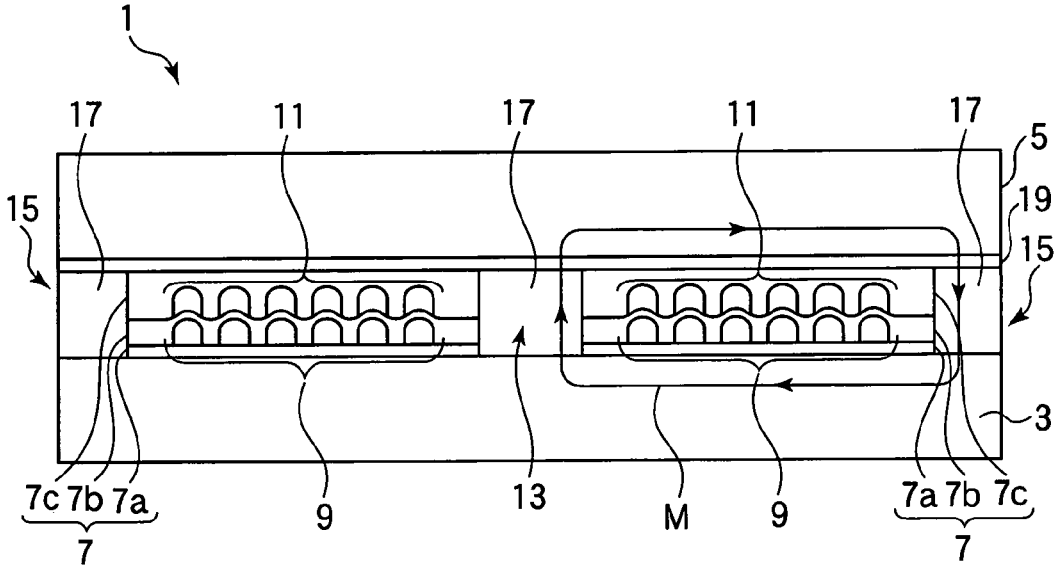
FIG. 1 is a sectional view of a common mode choke coil 1 according to an embodiment of the invention.

A coil component and a method of manufacturing the same according to an embodiment of the invention will now be described with reference to FIGS. 1 to 6. The present embodiment will be described with reference to a common mode choke coil for suppressing a common mode current that can cause electromagnetic interference during balanced transmission, as an example of a coil component. First, a configuration of a common mode choke coil 1 will be described with reference to FIG. 1. FIG. 1 shows a section of the common mode choke coil 1 taken along a plane including center axes of coil conductors 9 and 11.

As shown in FIG. 1, the common mode choke coil 1 of the present embodiment comprises an insulation film 7*a* formed of polyimide resin on a magnetic substrate 3 formed of ferrite, a spiral coil conductor (first coil conductor) 9 formed of a conductive material, another insulation film 7*b* formed of a shrinkable resist material, another spiral coil conductor (second coil conductor) 11 formed of a conductive material, and another insulation film 7*c* formed of polyimide resin, the elements being stacked in the order listed. As will be apparent from above, the coil conductors 9 and 11 are embedded in an insulation layer 7 constituted by the insulation films 7*a* to 7*c*.

The coil conductor 11 is disposed directly above the coil conductor 9 in a face-to-face relationship therewith with the insulation film 7*b* interposed between them. A plane of the coil conductor 9 orthogonal to the direction of a flow of a current through the conductor (a section of the coil) has a convex configuration in which the top portion of the coil section bulges in the middle thereof. The coil conductor 9 is formed such that the ratio between the height and the width of the section of the coil (aspect ratio=height/width) is 0.5 or more. In the present embodiment, a coil conductor 9 having an aspect ratio of substantially 1 in a section thereof is shown by way of example. Since the insulation film 7*b* formed on the coil conductor 9 is hardened such that it follows the shape of top portions (top surfaces) of the coil conductor 9 as a result of thermal shrinkage, the top portion (top surface) of the insulation film 7*b* has spiral irregularities in a general view of the same.

The coil conductor 11 is also formed to have an aspect ratio of 0.5 or more. In the present embodiment, a coil conductor 11 having an aspect ratio of substantially 1 in a section thereof is shown by way of example. The coil conductor 11 is formed on the convexes among the irregularities on the top surface of the insulation film 7*b* formed so as to follow the shape of the top surfaces of the coil conductor 9. Therefore, bottom portions (bottom surfaces)

of the coil conductor 11 are formed in a concave shape that follows the shape of the top surface of the insulation film 7*b*. Thus, the bottom portions of the coil conductor 11 are formed such that they follow the shape of the top surfaces of the coil conductor 9 with the insulation film 7*b* interposed between them, and the distance between the coil conductors 9 and 11 is substantially constant. The insulation film 7*b* between the coil conductors 9 and 11 is formed with a thickness which is also substantially constant.

An opening 13 is formed on an inner circumferential side of the coil conductors 9 and 11 by removing the insulation layer 7. An opening 15 is formed on an outer circumferential side of the coil conductors 9 and 11 by removing the insulation layer 7. A magnetic layer 17 is formed such that it fills the openings 13 and 15 to improve the degree of magnetic coupling between the coil conductors 9 and 11 and to improve impedance characteristics through an increase in common impedance. The magnetic layer 17 is formed of a composite ferrite obtained by mixing magnetic powder made of ferrite in polyimide resin. Further, a bonding layer 19 is formed on the magnetic layer 17 and the insulation film 7*c* to bond a magnetic substrate 5 formed of ferrite.

An operation of the common mode choke coil 1 of the present embodiment will now be described. When the coil conductors 9 and 11 are energized, as shown in FIG. 1, a magnetic path M is formed in a section including center axes of the coil conductors 9 and 11, the magnetic path passing through the magnetic substrate 3, the magnetic layer 17 in the opening 13, the bonding layer 19, the magnetic substrate 5, the bonding layer 19 again, and the magnetic layer 17 in the opening 15 in the order listed (or in the reverse order). The bonding layer 19 is a thin film having a thickness on the order of a few μm, although it is non-magnetic. Therefore, substantially no leakage of the magnetic flux occurs in this part, and the magnetic path M can be regarded as a substantially closed path.

The magnetic path length of the magnetic path M can be reduced by decreasing the interval between the coil conductors 9 and 11. As a result, the degree of magnetic coupling between the coil conductors 9 and 11 is improved, and the common mode filtering property of eliminating a noise component at a predetermined frequency is thereby improved. Since the coil conductors 9 and 11 have a low resistance owing to the sectional shapes of the coils having a high aspect ratio, the common mode choke coil 1 can be used in applications in which a relatively high current will flow through them.

Further, the bottom portions of the section of the coil conductor 11 are formed in a concave shape that follow the convex shape of the top portions of the section of the coil conductor 9 with the insulation film 7*b* having a substantially constant thickness interposed between them. Therefore, the distance between the coil conductors 9 and 11 can be kept substantially constant. As a result, a high capacitance can be generated between the coil conductors 9 and 11, which allows the degree of magnetic coupling between the coil conductors 9 and 11 to be improved to achieve a further improvement of the common mode filtering property.

As thus described, in the common mode choke coil 1, the magnetic path length can be made short by the use of the coil conductors 9 and 11 having a coil section with a high aspect ratio, and the degree of magnetic coupling between the coil conductors 9 and 11 can be improved by forming the bottom surface of the coil conductor 11 such that it follows the top surface of the coil conductor 9 to make the distance between the coil conductors 9 and 11 short and constant. As a result, the common mode choke coil 1 can be provided with a high common mode filtering property, and it can be provided with a small size and a small height.

A method of manufacturing a common mode choke coil 1 according to the present embodiment will now be described with reference to FIGS. 2A to 6. FIGS. 2A to 6 are sectional views of the common mode choke coil 1 taken at manufacturing steps along a plane including center axes of the coil conductors 9 and 11. Elements having effects and functions similar to those of the elements of the common mode choke coil 1 shown in FIG. 1 are indicated by like reference numerals and will not be described.

Figure 2A:
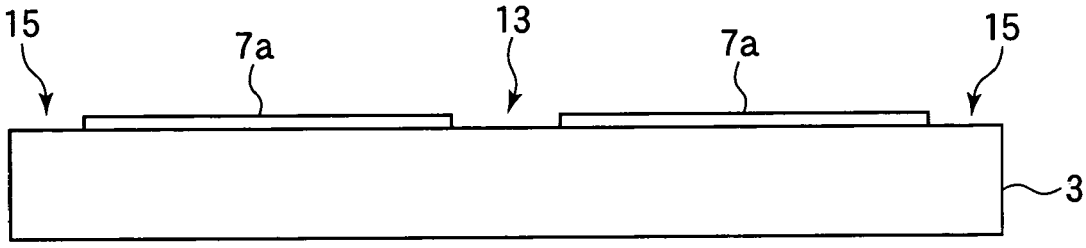
FIGS. 2A to 2C are sectional views of the common mode choke coil 1 according to the embodiment of the invention taken at manufacturing steps.

First, as shown in FIG. 2A, polyimide resin is applied to a thickness of 7 to 8 μm on a magnetic substrate 3 formed of ferrite, and the resin is patterned to form an insulation film 7*a*. The insulation film 7*a* is formed with openings 13 and 15. Next, a frame plating process is used to form a coil conductor 9. The frame plating process is a method of forming a plating film using a mold (frame) formed by patterning a resist layer.

Figure 2B:
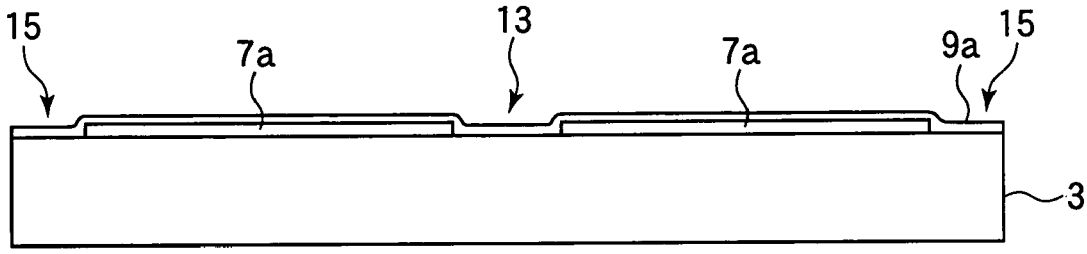

As shown in FIG. 2B, an electrode film 9*a* is formed on the entire surface using a sputtering process or evaporation process. A bonding layer constituted by two layers, e.g., a chromium (Cr) film having a thickness of 50 nm and a titanium (Ti) film having a thickness of 100 nm, may be formed under the electrode film 9*a* to improve the tightness of the bonding of the same to the insulation film 7*a*. The electrode film 9*a* is preferably made of the same material as the metal material to be plated, although there is no problem as long as the material has conductivity.

Figure 2C:
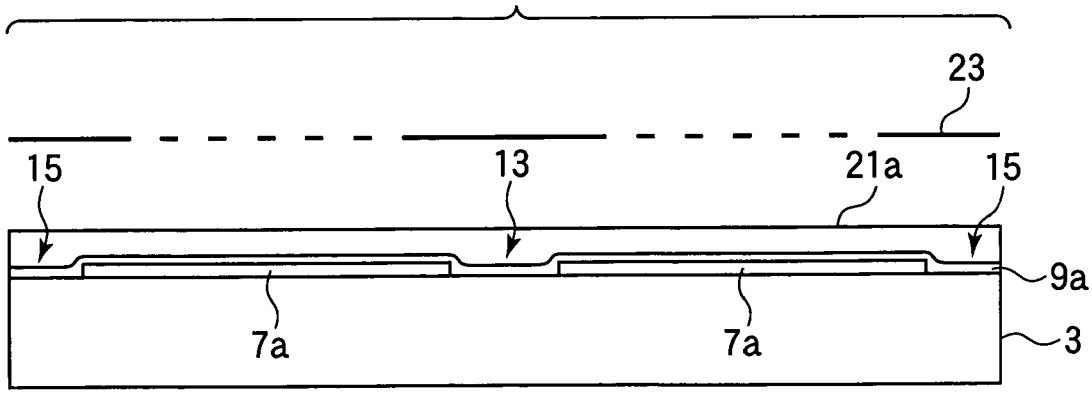

Next, as shown in FIG. 2C, a positive resist is applied to the entire surface to form a resist layer 21*a*, and a pre-baking process is performed on the resist layer 21*a* as occasion demands. A negative resist may be used for the resist layer 21*a*. Next, the resist layer 21*a* is exposed by irradiating it with exposure light through a mask 23 having a pattern for the coil conductor 9 drawn thereon.

Figure 3A:
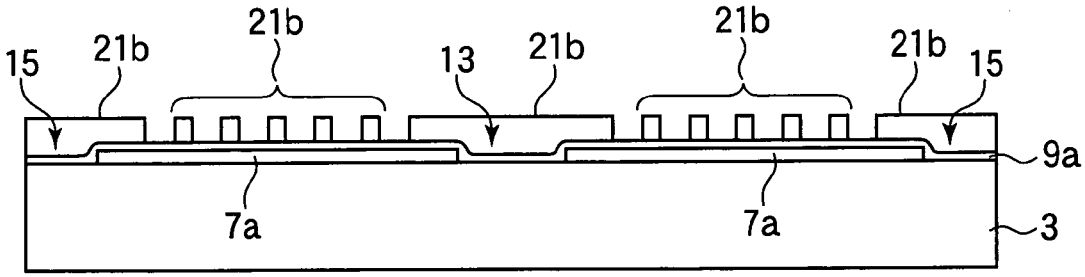

Then, development is performed using an alkali developing solution after performing a thermal process as occasion demands. For example, a tetramethyl ammonium hydroxide (TMAH) in a predetermined density is used as the alkali developing solution. The developing step is then followed by a cleaning step. The developing solution in the resist layer 21*a* is cleaned away using a cleaning fluid to stop the developing and dissolving reaction of the resist layer 21*a*, thereby forming resist frames 21*b* patterned in the shape of the coil conductor 9 as shown in FIG. 3A. For example, pure water is used as the cleaning fluid.

Figure 3B:
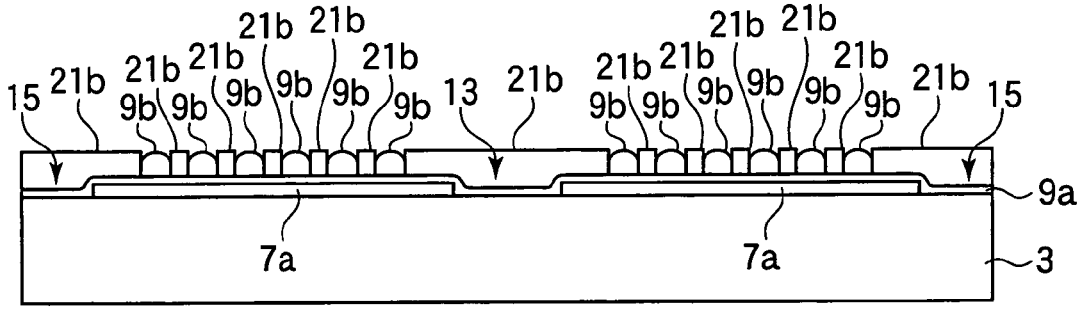
Figure 4A:
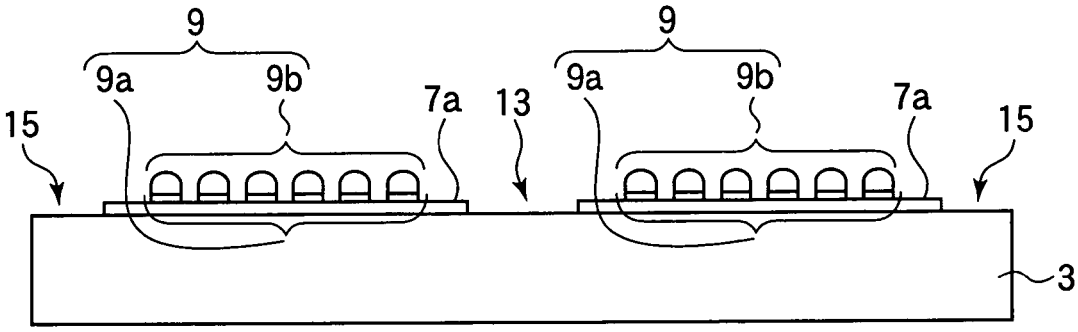
FIGS. 4A to 4C are sectional views of the common mode choke coil 1 according to the embodiment of the invention taken at manufacturing steps.

When the cleaning is completed, the cleaning fluid is scattered away to dry the substrate. The magnetic substrate 3 may be heated to dry and remove the cleaning fluid if necessary. Next, a plating process is carried out by immersing the magnetic substrate 3 in a plating solution in a plating bath and using the resist frames 21*b* as a mold to form a plating film 9*b* between the resist frames 21*b* as shown in FIG. 3B. The plating film 9*b* is formed to have a convex sectional configuration in which the top surface bulges in the middle thereof. Next, as shown in FIG. 3C, the resist frames 21*b* are removed from the electrode film 9*a* using an organic solvent after washing with water and drying the same as occasion demands. Next, as shown in FIG. 4A, the electrode film 9*a* is removed by performing dry etching (ion milling or reactive ion etching (RIE), etc.) or wet etching using the plating film 9*b* as a mask. Thus, a coil conductor 9 constituted by the electrode film 9*a* and the plating film 9*b* having a convex top surface is formed. The magnetic substrate 3 is exposed at the openings 13 and 15 because the electrode film 9*a* is dry-etched.

Figure 4B:
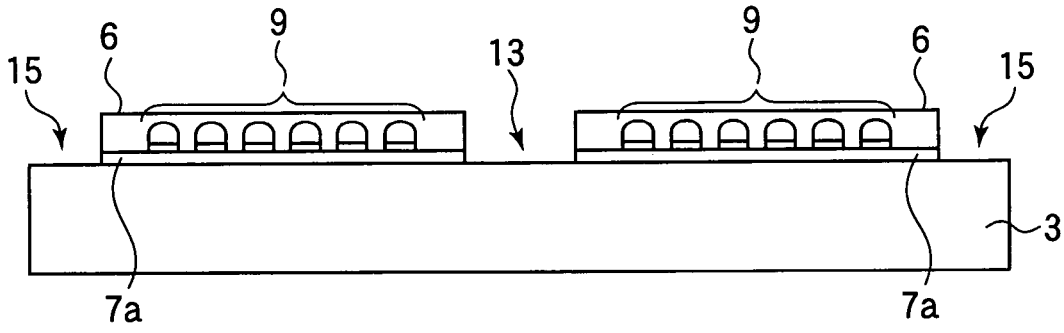
Figure 4C:
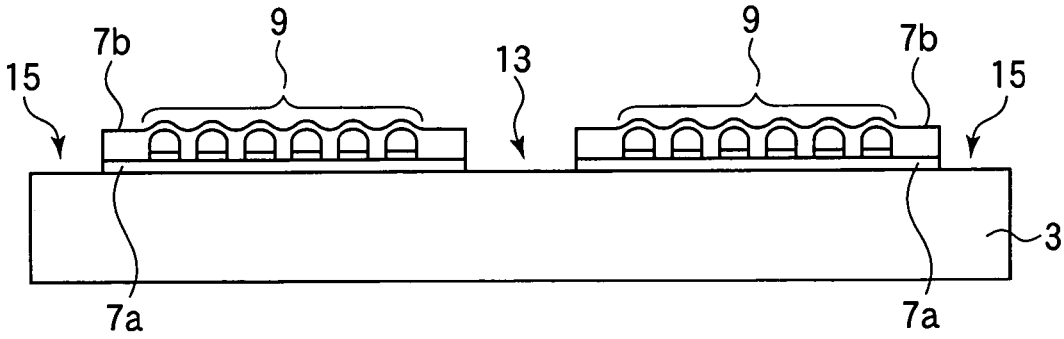

When the coil conductor 9 is formed using a frame plating process, a highly shrinkable resist material is applied to the entire surface and patterned as shown in FIG. 4B to form a resist film 6. The resist film 6 constitutes an insulation film 7*b* which is formed with openings 13 and 15 and which covers the coil conductor 9. The resist film 6 is applied and formed to such a thickness that the film becomes higher than the uppermost portion of the coil conductor 9 by 20% to 50% of the height (thickness) of the coil conductor 9. Next, as shown in FIG. 4C, the resist film 6 is thermally shrunk and hardened by heating it to 190° C. to form an insulation film 7*b*. Obviously, irradiation with UV light or the like may be also performed when the resist film 6 is hardened. The insulation film 7*b* has a certain thickness on the coil conductor 9, and the film is hardened so as to follow the convex shape of the top surface of the coil conductor 9, the top surface of the film consequently having spiral irregularities in a general view of the same. Thus, the top of the insulation film 7*b* has a wavy shape in a plane in parallel with a section of the coil.

Figure 5A:
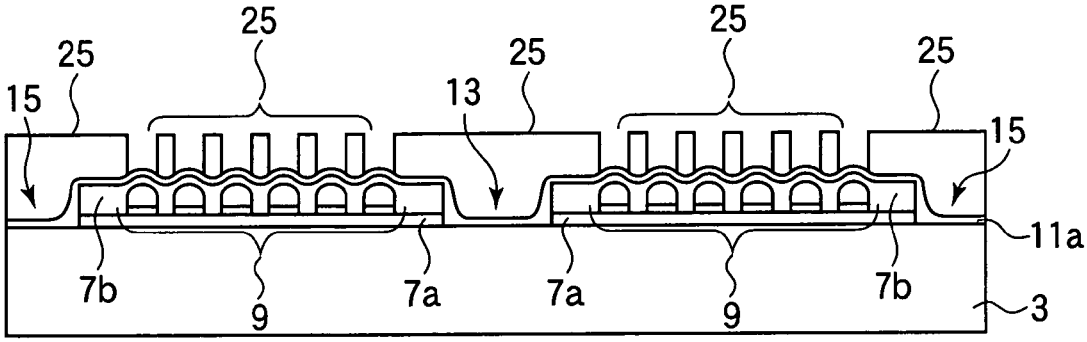
FIGS. 5A to 5C are sectional views of the common mode choke coil 1 according to the embodiment of the invention taken at manufacturing steps.
Figure 5B:
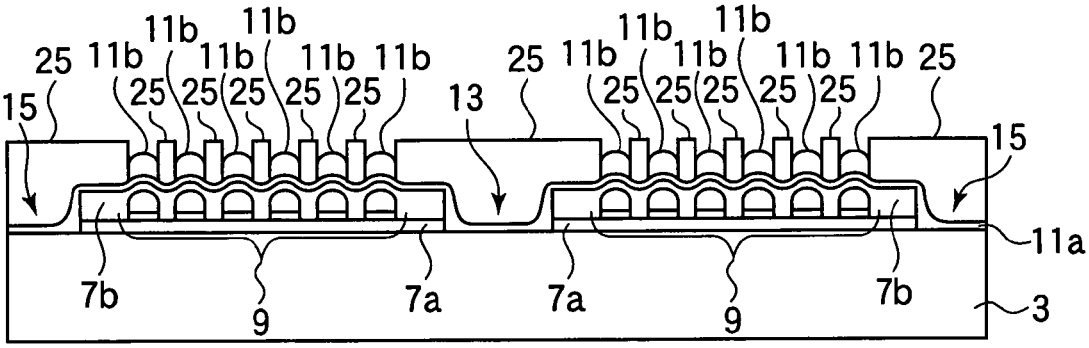

Next, a coil conductor 11 is formed on the insulation film 7*b* using a frame plating process. An electrode film 11*a* is formed on the entire surface as shown in FIG. 5A. A positive resist is then applied to the entire surface and patterned using a mask (not shown) having a pattern for the coil conductor 11 drawn thereon to form resist frames 25 which are patterned in the shape of the coil conductor 11. The resist frames 25 are formed at concaves of the insulation film 7*b* above the gaps between adjoining conductors of the coil conductor 9 such that the coil conductor 11 will be formed directly above the coil conductor 9 with the insulation film 7*b* interposed between them, the frames also being formed at the openings 13 and 15. The resist frames 25 may be formed using a negative resist. Next, a plating process is carried out by immersing the magnetic substrate 3 in a plating solution in a plating bath and using the resist frames 25 as a mold to form a plating film 11*b* between the resist frames 25 as shown in FIG. 5B. The bottom surface of the plating film 11*b* has concaves because it is formed so as to follow the convexes on the top surface of the insulation film 7*b*.

Figure 5C:
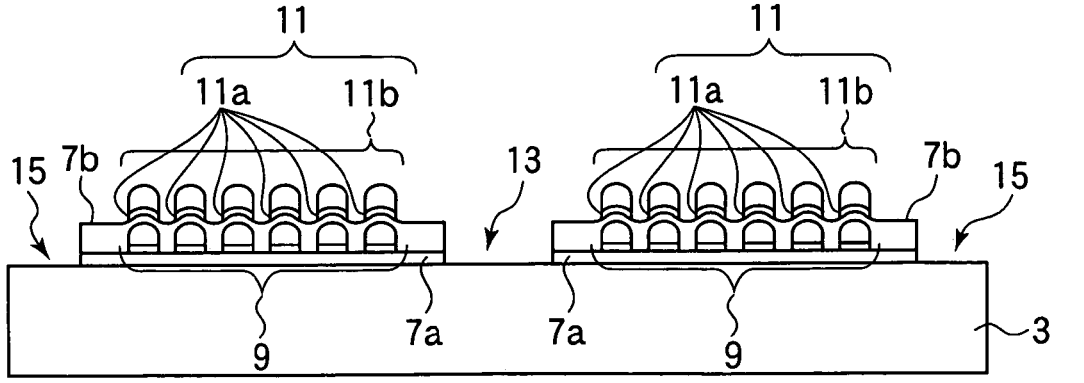
Figure 7A:
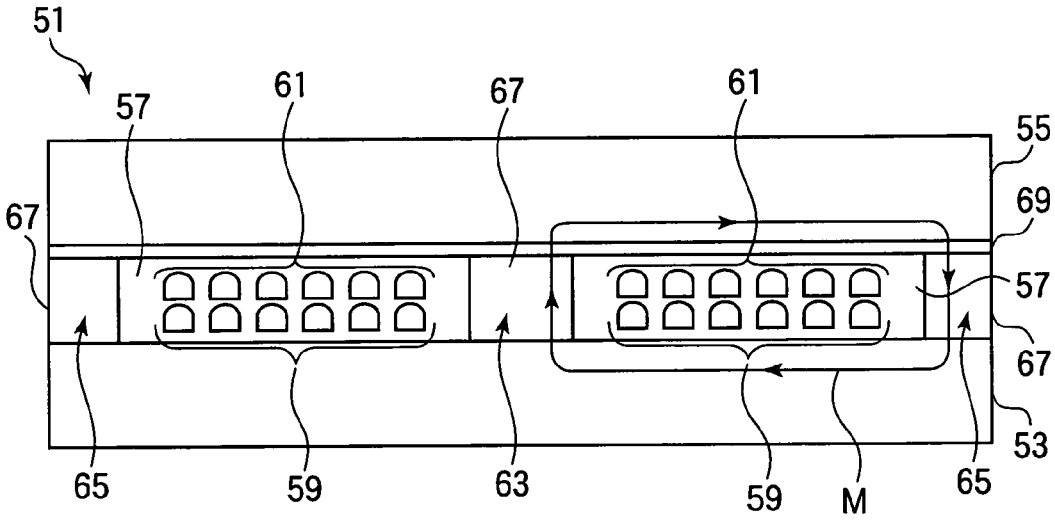
FIGS. 7A and 7B are sectional views of a common mode choke coil 51 according to the related art.
Figure 7B:
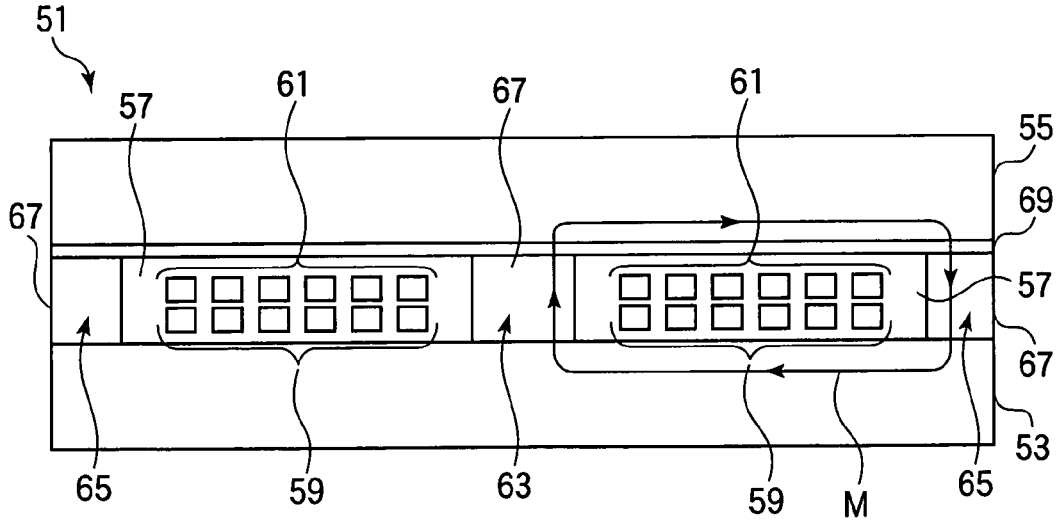

Next, as shown in FIG. 5C, the resist frames 25 are removed from the electrode film 11*a* using an organic solvent, and the electrode film 11*a* is removed by performing dry etching or wet etching using the plating film 11*b* as a mask. Thus, a coil conductor 11 constituted by the electrode film 11*a* and the plating film 11*b* having concaves on the bottom surface thereof is formed. The magnetic substrate 3 is exposed at the openings 13 and 15 because the electrode film 11*a* is dry-etched.

Figure 6:
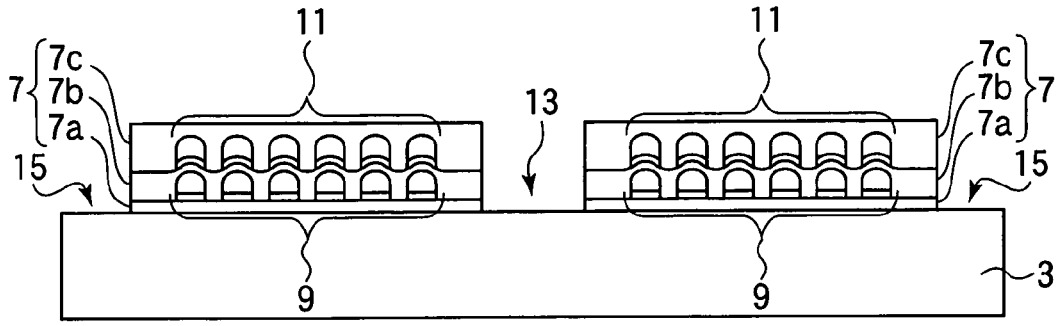
FIG. 6 is a sectional view of the common mode choke coil 1 according to the embodiment of the invention taken at a manufacturing step.

Next, as shown in FIG. 6, polyimide resin is applied to the entire surface and patterned to form an insulation film 7*c* which is then cured. The insulation film 7*c* is formed with the openings 13 and 15.

Next, although not shown, a magnetic layer 17 is formed by filling the openings 13 and 15 with a composite ferrite obtained by mixing magnetic powder made of ferrite in polyimide resin. A bonding agent is then applied to the magnetic layer 17 in the openings 13 and 15 and the insulation film 7*c* to form a bonding layer 19. Next, a magnetic substrate 5 is secured on the bonding layer 19.

Next, external electrodes (not shown) in connection with the coil conductors 9 and 11 are formed on sides of the magnetic substrates 3 and 5 opposite to each other such that they extend substantially perpendicularly to the substrate surfaces and across the magnetic substrates 3 and 5. A common mode choke coil 1 as shown in FIG. 1 is thus completed.

As described above, according to the method of manufacturing the common mode choke coil 1 in the present embodiment, since a highly shrinkable resist material is used for the insulation film 7*b* formed between the coil conductors 9 and 11, the distance between the coil conductors 9 and 11 can be kept short and constant. As a result, magnetic coupling between the coil conductors 9 and 11 is improved to allow the common choke coil 1 to be formed with a high common mode filtering property. Further, sufficiently strong magnetic coupling can be achieved between the coil conductors 9 and 11 without planarizing the convex portions on the top surface of the coil conductor 9 resulting from increase in the aspect ratio of the sectional shape of the coil. Since this makes it possible to reduce the number of steps for manufacturing the common mode choke coil 1, the manufacturing cost can be reduced to provide the common mode choke coil 1 at a low cost.

The invention is not limited to the above-described embodiment and may be modified in various ways.

While the coil conductor 9 in the above-described embodiment is formed with a convex configuration in which a top portion of the conductor in a section thereof bulges upward in the middle thereof, this is not limiting the invention. Even if the top portion in the section has a wavy shape or concave shape, since the insulation film 7*b* can be formed so as to follow the shape of the top surface of the coil conductor 9, the bottom surface of the coil conductor 11 formed on the insulation film 7*b* can be formed so as to follow the top surface of the coil conductor 9. Since the distance between the coil conductors 9 and 11 can therefore be kept short and constant, the same advantage as that in the above embodiment can be achieved.

While the coil conductor 11 in the above-described embodiment is formed with a convex configuration in which a top portion of the conductor in a section thereof bulges upward in the middle thereof, this is not limiting the invention. The same advantage as described in the above embodiment can be achieved even when the top surface of the coil conductor 11 has a wavy, concave or planar shape.

While the above-described embodiment includes the magnetic layer 17 which is formed to be embedded in the openings 13 and 15, this is not limiting the invention. The same advantage as that in the above embodiment can be achieved by a structure in which the openings 13 and 15 and the magnetic layer 17 are not formed.

What is claimed is:

1. A coil component comprising:

a first coil conductor formed with a curved top portion;

an insulation film formed on the first coil conductor so as to follow the shape of the top portion of the first coil conductor;

a second coil conductor formed on the insulation film, the second coil conductor having a bottom portion formed so as to follow the shape of a top portion of the insulation film, wherein a bottom portion of the second coil conductor is formed in a concave shape that follows the shape of a top surface of the insulation film.

2. The coil component according to claim 1, wherein the center of the top portion of the first coil conductor has a convex shape in a section of the coil.

3. The coil component according to claim 1, wherein the second coil conductor is formed directly above the first coil conductor with the insulation film interposed between them.

4. The coil component according to claim 1, wherein at least either of the first or the second coil conductors is formed such that a section of the coil has an aspect ratio of 0.5 or more.

5. The coil component according to claim 1, wherein a distance between the first and the second coil conductors is substantially constant.

6. The coil component according to claim 1, wherein the insulation film is formed of a shrinkable resist material.

7. The coil component according to claim 1, wherein the second coil conductor is formed on a convex portion among the irregularity of a top surface of the insulation film formed so as to follow the shape of a top surface of the first coil conductor.

* * * * *